United States Patent [19]

Kuizinas

[11] Patent Number: 4,995,371

[45] Date of Patent: Feb. 26, 1991

[54] BALL THROWING MACHINE

[76] Inventor: Joseph Kuizinas, 34 Merriam Rd., North Oxford, Mass. 01537

[21] Appl. No.: 471,620

[22] Filed: Jan. 29, 1990

[51] Int. Cl.[5] ..... F41B 3/04; A63B 69/40

[52] U.S. Cl. ..... 124/7; 124/50; 124/36; 273/26 D

[58] Field of Search ..... 124/16, 31, 36, 41.1, 124/45, 49, 50, 51.1, 52, 53, 80, 7; 273/26 D

[56] References Cited

U.S. PATENT DOCUMENTS

| | | | |
|---|---|---|---|
| 1,146,262 | 7/1915 | Judd | 124/7 |
| 1,897,317 | 2/1933 | McEachern | 124/50 X |
| 2,650,585 | 9/1953 | Farre, Jr. | 124/7 |
| 2,690,169 | 9/1954 | Emilian | 124/36 X |
| 3,262,439 | 7/1966 | Johns | 124/7 |
| 3,308,802 | 3/1967 | Applegate | 124/50 X |
| 3,470,859 | 10/1969 | Ponza | 124/36 X |
| 4,015,578 | 4/1977 | Wright | 124/36 X |
| 4,132,214 | 1/1979 | Schnurr et al. | 124/50 X |
| 4,269,162 | 5/1981 | Abraham et al. | 127/7 |
| 4,391,264 | 7/1983 | Abraham et al. | 124/36 X |
| 4,611,571 | 9/1986 | Tressler et al. | 124/7 |
| 4,784,107 | 11/1988 | Kelly | 124/50 X |

*Primary Examiner*—Peter M. Cuomo
*Assistant Examiner*—Jeffrey L. Thompson
*Attorney, Agent, or Firm*—H. Gibner Lehmann; K. Gibner Lehmann

[57] ABSTRACT

A ball throwing machine for tossing a plurality of balls in succession, one at a time. The machine has a frame adapted to rest on a supporting surface, a spring-loaded pivotally mounted catapult arm that receives, holds, and tosses the balls, and a cam wheel and cam wheel shaft turnably mounting the cam wheel on the frame. The shaft has an axis which is laterally offset from the pivot axis of the catapult arm. The cam wheel has peripheral teeth, and a power driven pinion engages the teeth to impart turning movement to the wheel. There are cam rollers on the wheel which engage, one at a time, a cam plate on the catapult arm. The arrangement is such that the catapult arm is periodically shifted toward a ball-receiving position, picks up a ball, and as the cam wheel turns further, one cam roller by-passes the cam plate enabling the catapult arm to snap under the action of the spring and toss the ball. A cushion is disposed between the cam wheel shaft and catapult arm, operable after the catapult arm is released, to abruptly cushion the halting of the catapult arm when it arrives at the ball-tossing position, to thereby minimize noise and undesireable stress and/or jarring of the arm and the cam wheel shaft.

16 Claims, 2 Drawing Sheets

22
16
62
60
36
66
44
40
38
42
58
56
54
52
50
48
24
12
30
28
32
86
88
89
76
34
64
65
46
61
26

BALL THROWING MACHINE

NO CROSS REFERENCES TO RELATED APPLICATIONS

STATEMENT AS TO RIGHTS TO INVENTIONS MADE UNDER FEDERALLY-SPONSORED RESEARCH AND DEVELOPMENT.

Research and development of the present invention and application have not been Federally-sponsored, and no rights are given under any Federal program.

BACKGROUND OF THE INVENTION

1. Field of the Invention

This invention relates to automatic ball throwing machines, and more particularly to devices of a type wherein an automatic feed is had from a supply of balls contained in a bin or magazine.

2. Description of the Related Art Including Information Disclosed Under 37 CFR §§1.97-1.99

A typical ball throwing apparatus is illustrated in U.S. Pat. No. 4,269,162 which discloses broadly the use of a spring loaded catapult or tossing arm which is periodically cocked by a motor driven arm, in order to achieve the ball tossing function. The motor driven arm as shown makes one complete revolution for each ball throwing operation, and as such is arranged to turn at the desired rate for delivery of balls to the batter. A bumper block (121) is mounted at a location on the frame that is remote from the location of the motor driven arm.

The disclosed magazine or ball feed device for this apparatus consists of a basket having at one end near the bottom, a pivotal chute which is raised and lowered by the same motor which cocks the catapult arm. Associated with the feed mechanism is an anti-jamming linkage having a roller (146) which reciprocates to engage balls upstream of the ball desired to be withdrawn, and prevents such balls upstream from rubbing against the one ball and possibly interfering with its feed by gravity, down the chute to the catapult arm.

While the patented device is believed to operate in a satisfactory manner, one can readily determine that it is relatively complex, involving multiple linkages and a plurality of moving parts, some of which must be closely synchronized in their movements in order to assure smooth, jam-free operation, especially in the area of the ball feed magazine. In addition, it is believed that the physical size of the device illustrated is such as to render it relatively too bulky and cumbersome to transport, which is a distinct disadvantage for ball throwing machines, where their use is usually intended for temporary set-up and take-down, as at a ball field during practice sessions, or prior to commencement of a game. Also, use of a machine by an individual in the yard of a private residence would dictate that it be relatively light in weight and portable, so as to permit it to be readily carried out from a storage area such as a shed or garage, and thereafter easily returned thereto after use.

U.S. Pat. No. 2,650,585 illustrates a ball throwing machine incorporating a spider wheel carrying three circumferentially disposed cam rollers that cooperate with a cam mounted on a spring biased ball-tossing arm. An adjustable stop is provided in order to limit the extent of snap of the arm, which in turn governs both the flight path of the balls and the speed at which they are delivered. A bumper device (13) presumably constituted of rubber, is carried at the end of the adjustable stop. The bumper is remote from the location of the main drive shaft for the spider wheel. Again, the disclosed device is seen to be relatively complicated and heavy, thus not lending itself to portable use.

Other types of ball pitching machines are illustrated in U.S. Pat. Nos. 1,146,262, and 3,262,439. In No. '262, the snap movement is imparted to a ball by means of a spring loaded pitching arm (27) which is retracted as the main arm (16) turns at a constant rate, until the pitching arm by-passes rollers (47, FIG. 5) and snaps the ball forward.

In No. '439, a roller carried on a turnably driven shaft engages a cam arm (17) which in turn shifts a tossing arm to a cocked position against the action of a spring. When the roller by-passes the cam arm, the tossing arm is released with a snap movement.

The various designs noted above have apparently at best, met with limited success in the marketplace. It is believed that the relative complexity of the machines, together with their lack of portability, has resulted in poor overall acceptance in the field.

SUMMARY OF THE INVENTION

The above disadvantages and drawbacks of prior ball throwing machines are largely obviated by the present invention which has for one object the provision of a novel and improved ball throwing machine which is especially simple in construction, lightweight, and completely portable, to enable the machine to be readily transported by one person to and from different locations, such as field houses, ball fields or other locations where batting practice is to be undertaken.

A related object of the invention is to provide an improved ball throwing machine as above set forth, which is completely self contained, and which is especially user friendly and simple to operate and load.

Still another object of the invention is to provide an improved ball throwing machine which incorporates a unique ballfeed mechanism which is both especially simple, and not susceptible to inadvertent jamming or malfunction.

Yet another object of the invention is to provide an improved ball throwing machine of the kind indicated, wherein existing components of readily available mechanisms can be incorporated into the machine, with a minimum of modification, and with reduced manufacturing/assembly cost.

A still further object of the invention is to provide an improved ball throwing machine as outlined above, wherein the shock or impulse forces resulting from the throwing operation are dampened in an especially simple and efficient manner, to reduce the overall noise level during the operation of the machine, and to virtually eliminate damaging stresses that would otherwise be applied to certain parts of the machine, which stresses could cause premature fracture or fatigue of metal components, and ultimate failure of the device.

Another object of the invention is to provide an improved ball throwing machine in accordance with the foregoing, wherein there is provided a novel shock absorbing arrangement that is both simple in its structure, and which is capable of being easily replaceable on a periodic basis, thereby resulting in long life expectancy and excellent reliability in operation over extended periods of use.

Still another object of the invention is to provide an improved ball throwing machine as above characterized, wherein the individual parts are rugged and reliable, and capable of operation over many thousands of cycles as would typically be required for pitching machines, substantially without deterioration in use and without premature failure.

The above objects are accomplished by a ball throwing machine, comprising a frame adapted to rest on a supporting surface, a catapult arm having means for receiving and holding a ball, and a pivot on the frame, mounting the catapult arm for arcuate movement between a ball-receiving position and a ball tossing position. Spring means are provided, for biasing the catapult arm toward the ball-tossing position. A cam wheel and a cam wheel shaft turnably mount the cam wheel on the frame. The shaft has an axis which is laterally offset from the axis of the pivot for the catapult arm. There are also provided powered means for turnably driving the cam wheel, and cooperable cam means on the cam wheel and catapult arm, acting against the spring biasing means, for periodically shifting the catapult arm toward the ball-receiving position as the cam wheel turns, and for releasing the catapult arm at a predetermined position of rotation of the cam wheel, thereby to enable the catapult arm to be snapped under the action of the spring biasing means. Cushion means are disposed between the cam wheel shaft and catapult arm, operable after the catapult arm is released, to cushion the halting of the catapult arm when it arrives at the ball-tossing position, thereby to reduce noise and lessen undesirable stress forces.

The objects are further accomplished by a ball feed guide for a ball throwing machine, comprising in combination a frame member adapted to be positioned on a supporting surface, an elongate guide member, and stop means pivotally mounted on one of the members. The guide member has an entrance to receive balls and is disposed at an angle with respect to the horizontal, to allow for gravity feed of the balls toward one end thereof, such end having an exit through which balls can be released. The stop means comprises spaced apart abutments to accommodate a single ball and to simultaneously block upstream balls. An actuator arm is provided, capable of moving the stop means toward the entrance of the guide member so as to load and accept solely one ball. Following loading of the ball, the stop means is shifted by the actuator arm toward the exit of the guide member, to thereby unload and release the ball. The arrangement is such that an extremely simple and jam-free structure is realizeable, with little likelihood of malfunction even over extended periods of use.

Other features and advantages will hereinafter appear.

BRIEF DESCRIPTION OF THE DRAWINGS

In the drawings, illustrating a preferred embodiment of the invention.

DESCRIPTION OF THE PREFERRED EMBODIMENT

Figure 2:
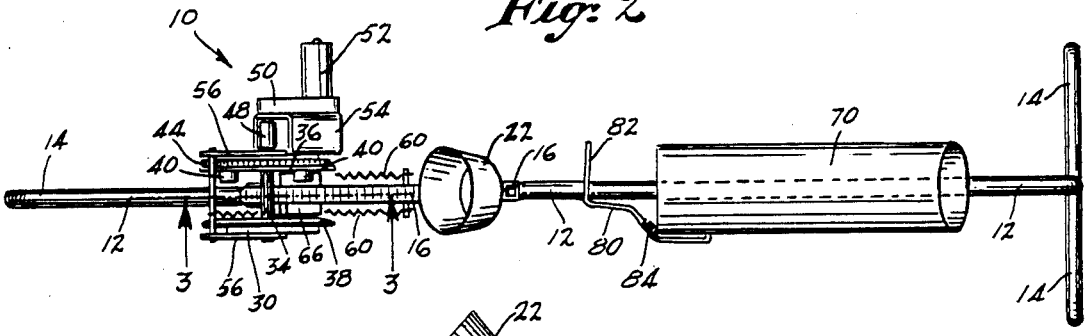
FIG. 2 is a top plan view of the machine of FIG. 1.
Figure 1:
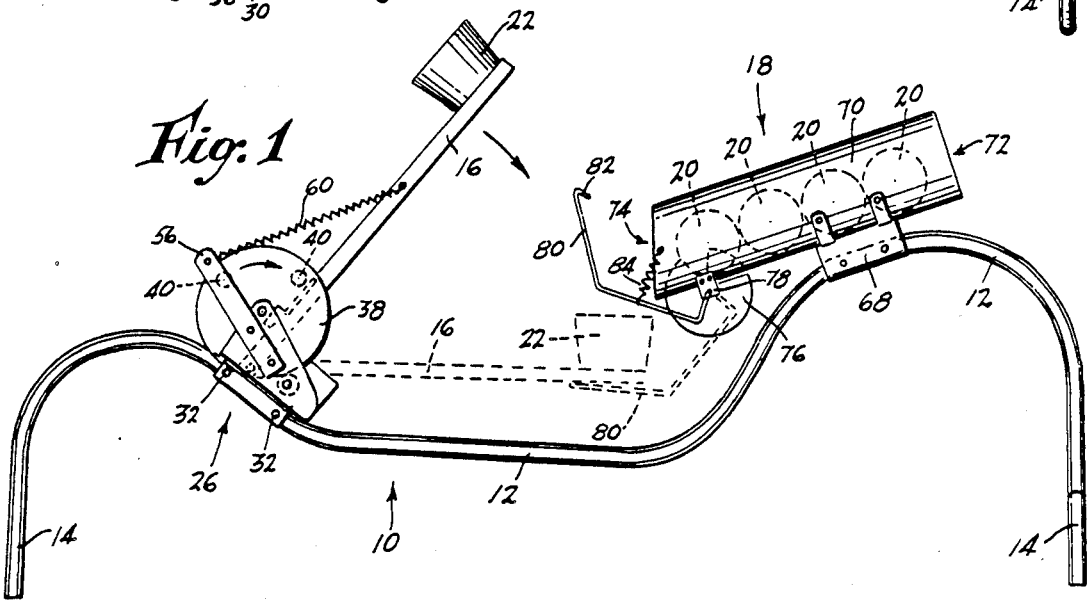
FIG. 1 is a side elevation of the improved ball throwing machine of the invention, with the catapult arm shown in solid outline occupying a ball-throwing position, and in dotted outline, occupying a ball-receiving position.

Referring to FIGS. 1–4 there is illustrated a ball throwing machine generally designated by the numeral 10, comprising a frame 12 constructed of metal tubing forming a tripod having legs 14 and a catapult arm 16 pivotally mounted on the frame and movable between a ball-receiving position illustrated in dotted outline in FIG. 1, and a ball-tossing position illustrated in solid outline in this figure. Also carried on the frame 12 is a ball feed mechanism 18 adapted to store a quantity of balls 20, such as baseballs, tennis balls or the like, and to release them one at at time into a receiving cup 22 of the catapult arm 16, as will be explained further below.

Figures 3, 4, 5:
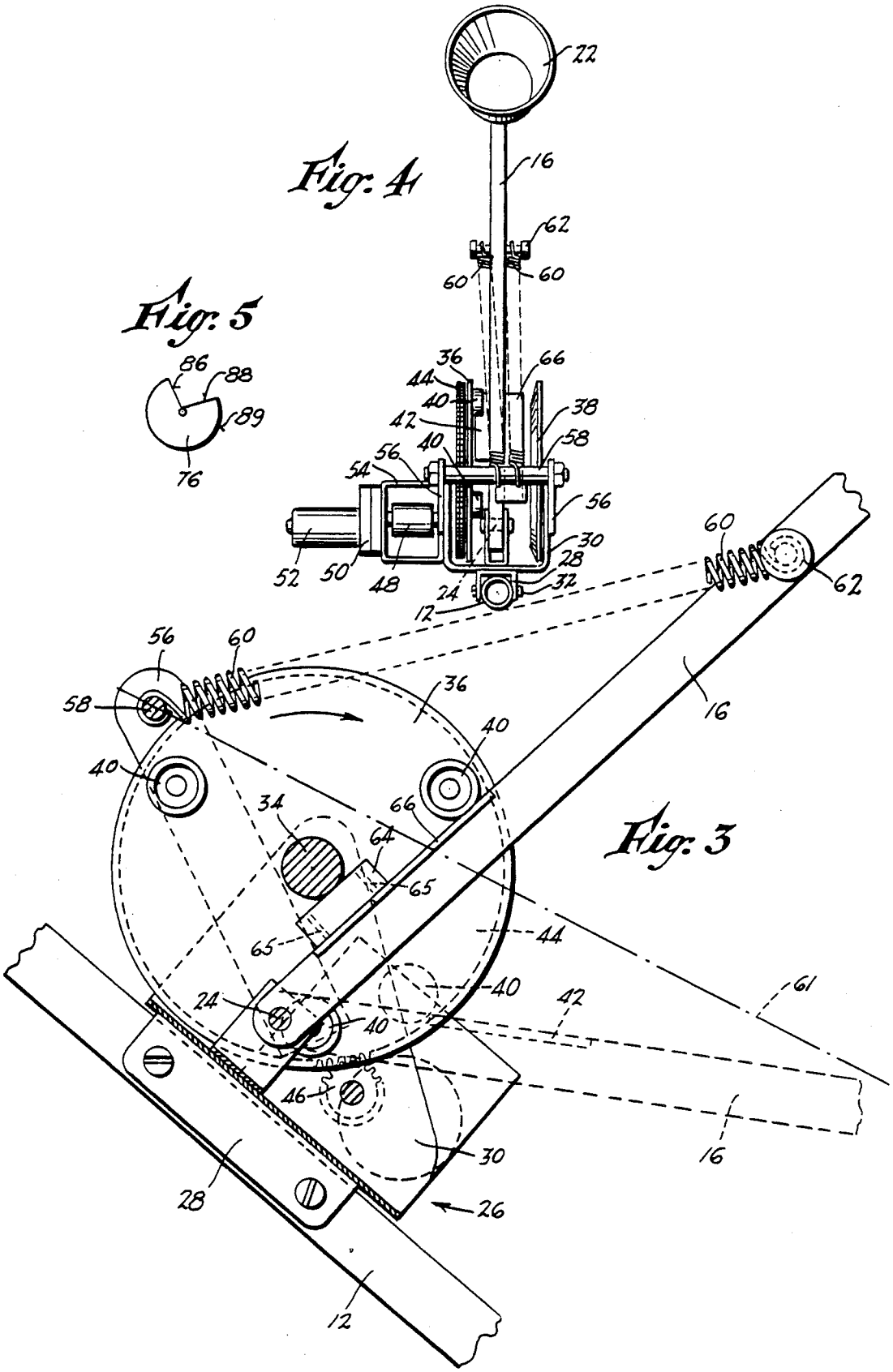
FIG. 3 is a vertical section taken on the line 3—3 of FIG. 2.
FIG. 4 is view partly in plan and partly in section, of the catapult arm and drive mechanism therefor, of the ball throwing machine.
FIG. 5 is a side elevation of a ball stop and control member as employed with the ball feed mechanism of the machine of the present invention.

The catapult arm 16 is pivotally mounted on the frame 12 by means of a pivot pin 24, FIG. 3, carried on a bracket 26 formed of two back-to-back channel members 28, 30, the channel member 28 being secured to the frame 12 by means of bolts 32, FIGS. 1 and 4. The other channel member 30 has aligned apertures constituting bearing sleeves for a drive shaft 34 that is rigid with a pair of wheels 36, 38, one wheel 36 being a cam wheel. Secured to the cam wheel 36 are three circumferentially spaced cam rollers 40 arranged to selectively engage a cam plate 42 carried on the catapult arm 16 at a location near the pivoted end thereof.

The cam plate 42 extends laterally of the catapult arm 16 so as to lie in the path of the cam rollers 40 when the cam wheel 36 is turnably driven by shaft 34.

In turnably driving the cam wheel 36, a face plate gear 44 having peripheral teeth is provided, rigid with the cam wheel 36 and wheel 38, and with the shaft 34. The gear 44 is engaged by a pinion 46, FIG. 3, which is driven through a flexible coupling 48 and gear box 50. The latter is in turn driven by an electric motor 52, powered by a suitable source of d.c., such as a storage battery (not shown). The motor 52 and gear box 50 are mounted on a bracket 54 secured to the bracket 30, which is rigid on the frame 12.

Two struts 56 are fastened to the bracket 30, and have aligned holes through which a bolt 58 extends, fastened by a nut. Two extension springs 60 are provided, each having its one end attached to the bolt 58, and its other end attached to the catapult arm 16 by means of a suitable bolt 62. The springs 60 bias the catapult arm 16 in a counterclockwise direction in FIG. 1, toward the ball-tossing position illustrated in solid outline in this figure.

In accordance with the present invention, with the pivot axis of the catapult arm 16, namely the axis of pin 24, offset with respect to the axis of the drive shaft 34, there is provided a unique impact absorber or cushioning means in the form of a bumper block 64 constituted of resilient, shock-absorbing material such as rubber, carried by pins 65 and optionally cemented on a laterally extending bracket 66 of the catapult arm 16, which bumper engages the drive shaft 34 of the cam mechanism. The bracket 66 is illustrated in FIG. 4, and extends in a direction opposite to that of the cam plate 42. Both the cam plate 42 and the bumper block bracket 66 are coextensive with one another, however, and with the catapult arm 16.

When the catapult arm 16 is disposed in its ball-tossing position, as in solid outline in FIG. 1, the bumper block 64 directly engages the drive shaft 34, the latter constituting a positioning shoulder or stop for the catapult arm 16. The bumper block 64 absorbs impact forces produced when the catapult arm 16 is released and snaps counterclockwise in FIG. 1, as will be described below.

It is noted that the pivot pin 24 for the catapult arm is perpendicular to the cam wheel 36, and the axis thereof is seen to intersect the wheel at a point intermediate the wheel's periphery and its center.

Also carried on the frame is the novel ball feed mechanism 18. A bracket 68 secures a tubular pipe-like magazine or ball supply tube 70, which has an entrance opening 72 and an exit opening 74. With the frame 12 disposed on a horizontal surface, the supply tube 70 is inclined as illustrated so as to provide a gravity feed of the balls 20 toward the exit opening 74.

By the invention there is provided a ball control and positioning member 76, particularly illustrated in FIG. 5, pivotally mounted on the magazine by means of a bracket 78. Attached to the ball control and positioning member 76 is an actuator arm 80 having a reverse bend 82 in its end and adapted to be engaged by the catapult arm 16 when the latter moves toward its ball-receiving position. An extension spring 84 extends between the actuator arm 80 and the supply tube 70. The ball stop and positioning member 76 is also hereinafter referred to as a disk-like member, and has an arcuate cut-out with abutment shoulders 86, 88, at the edges of the cut-out. The member has an arcuate edge 89 which operates to block the balls 20 immediately upstream of the ball 20 occupying the cut-out of the disk-like member 76. The disk-like member 76 extends into a slot in the supply tube 70 by a distance which is somewhat less than the diameter thereof. The ball-holding position of the member is illustrated in solid outline in FIG. 1, and the ball-releasing/ball blocking-position illustrated in dotted outline in this figure. The "ball-releasing" function refers to the ability of the member 76 to release to the exit, the single ball occupying the arcuate cut-out whereas the "ball-blocking" function refers to the ability of the same member 76 to simultaneously block the upstream balls 20 while the release of the single ball 20 is occurring.

While four balls 20 are shown as occupying the supply tube 70, the length of the tube 70 can be extended as desired, in order to accommodate additional balls, and in addition, a basket attachment (not shown) can be included at the entrance opening 72 of the tube, for added ball capacity.

The operation of the improved ball throwing machine of the invention may be readily understood by referring to the figures. With a supply of balls 20 loaded into the supply tube 70 and with the various components of the machine having the positions illustrated in solid outline in FIG. 1, the motor 52 is energized, with suitable switching, not shown. It drives the pinion 46 via the gear box 50 and flexible coupling 48, in a known manner. The pinion 46 in turn drives the face plate gear 44, drive shaft 34 and wheels 36, 38, at a rate of typically one revolution per minute or less. From the position of FIGS. 1 and 3, wherein the bumper 64 is in engagement with the drive shaft 34, one cam roller 40 engages the cam plate 42, which latter as noted above, lies in the path of movement of all three cam rollers 40. As this occurs, the catapult arm 16 is pivoted clockwise in FIG. 1, against the action of the springs 60. The free end of the catapult arm 16, carrying the cup 22, eventually engages the end 82 of the actuator arm 80, causing pivoting of the disk-like member 76. At approximately the time that the catapult arm 16 has reached its extreme clockwise position, the disk-like member 76 will have turned sufficiently to release the lowermost ball 20, which occupied its cut-out. The released ball 20 thus rolls into the receiving cup 22. With slight additional rotation of the cam wheel 36 and clockwise pivoting of the catapult arm 16, the cam roller 40 eventually arrives at the end of the plate at which time the springs 60 will be parallel to the dotted line 61 in FIG. 3. The roller 40 then suddenly by-passes the end of the cam plate 42, enabling the catapult arm 16 to snap counterclockwise in FIG. 1, under the action of the springs 60, until the bumper block 64 impacts against the main drive shaft 34, causing the ball 20 to be released with the desired velocity and in a direction toward the left in this figure. By the invention, the impact of the catapult arm 16 against the drive shaft 34 is cushioned by the bumper block 64, thereby reducing the overall noise which would otherwise result from the sudden striking of the catapult arm 16 against the drive shaft 34, and also reducing undesirable stresses in both components, which might otherwise lead to eventual fracture or fatigue of the metal and ultimate failure of the machine.

Prior to the arrival of the catapult arm 16 at the supply tube 72, that portion 89 of the curved outer surface of the disk-like member 76 adjacent the edge 88, engages and blocks the ball 20 immediately upstream from the one being released. Thus, all balls except the one being released are supported and held in their existing positions. Upon release of the catapult arm 16, the spring-biased actuator arm 80 pivots the disk-like member 76 clockwise once again, and the next ball 20 rolls into the arcuate cut-out of the member 76.

In operation, with three cam rollers 40, the catapult arm undergoes three reciprocations with each revolution of the cam wheel 36, and it has been found that with a one r.p.m. rate of revolution, one ball is tossed at approximately 20 second intervals, which allows time for the batter to prepare himself, between swings.

The illustrated construction has the following advantages. The operating mechanisms are extremely simple in their structure and light in weight, thereby enabling the unit to be portable, and easy to carry and transport. The drive motor 52, gear box 50, flexible coupling 48, face plate gear 44 and cam wheel 36 (and wheel 38, which has no particular function in the present apparatus) can be readily adapted from a conventional boat power winch, thereby reducing the overall cost considerably.

The velocity with which the balls are tossed can be adjusted by the addition of extra springs, corresponding to those indicated 60. On the other hand, a single spring 60 could be employed, having any desired stiffness coefficient.

The ball feed mechanism, being extremely simple, also lends itself to portability and ease of operation. Loading of the balls is greatly facilitated, and it has been found that the possibility of inadvertent jamming of the ball feed mechanism is virtually non-existent.

Should replacement of the bumper block 64 be required, typically after a few thousand cycles, this is readily accomplished by merely removing the original block from the plate 66, and placing and/or cementing a new block in its place. In the disclosed construction, the block is completely accessible, thereby facilitating such replacement.

In actual tests performed on a working model of a ball throwing machine constructed as depicted in the accompanying drawings and in accordance with the invention, in excess of 50,000 cycles of operation has been successfully obtained, without failure or malfunction of the various components.

The device thus described above is seen to represent a distinct advance and improvement in the field of ball throwing machines.

Variations and modifications are possible without departing from the spirit of the invention.

Each and every one of the appended claims defines an aspect of the invention which is separate and distinct from all others, and accordingly it is intended that each claim be treated in this manner when examined in the light of the prior art devices in any determination of novelty or validity.

What is claimed is:

1. A ball throwing machine, comprising in combination:

(a) a frame adapted to rest on a supporting surface, (b) a catapult arm having means for receiving and holding a ball, (c) pivot means on said frame, mounting said catapult arm for arcuate movement between a ball-receiving position and a ball-tossing position, (d) spring means biasing said catapult arm toward said ball-tossing position, (e) a cam wheel and a cam wheel shaft turnably mounting the cam wheel on the frame, said shaft having an axis which is laterally offset from the axis of the pivot means of the catapult arm, (f) powered means for turnably driving said cam wheel, (g) cooperable cam means on said cam wheel and catapult arm, acting against said spring biasing means, for periodically shifting said catapult arm toward said ball-receiving position as the cam wheel turns, and for releasing said catapult arm at a predetermined position of rotation of said cam wheel, thereby to enable the catapult arm to be snapped under the action of the spring biasing means, and (h) cushion means disposed between said cam wheel shaft and catapult arm, operable after the catapult arm is released, to cushion the halting of the catapult arm when it arrives at the said ball-tossing position, thereby to reduce the stress experienced by the catapult arm.

2. The invention as set forth in claim 1, wherein:

(a) said cam means comprises multiple cam rollers on the cam wheel, and a cam plate on the catapult arm, engageable with the rollers one at a time.

3. The invention as set forth in claim 2, wherein:

(a) the cam wheel has three cam rollers, (b) the movement of said catapult arm is characterized by periodic reciprocations, and (c) the catapult arm reciprocates three times for reach revolution of the cam wheel.

4. The invention as set forth in claim 1, wherein:

(a) said cam wheel has means defining peripheral teeth, (b) said powered means comprising a pinion turnably mounted on the frame and engageable with said teeth, and (c) an electric motor connected to drive said pinion.

5. The invention as set forth in claim 1, wherein:

(a) said cam means comprises a cam plate mounted on said catapult arm.

6. The invention as set forth in claim 5, wherein:

(a) said cam plate moves either toward or away from said cam wheel shaft with the movement of the catapult arm between its ball-receiving position and its ball-tossing position, respectively.

7. The invention as set forth in claim 1, wherein:

(a) said spring means comprises two extension springs, one end of each spring being connected to the frame, and the other end of each spring being connected to the catapult arm.

8. The invention as set forth in claim 7, wherein:

(a) said springs are coextensive with one another.

9. The invention as set forth in claim 1, wherein:

(a) said cushion means comprises a block of shock-absorbent material mounted on the catapult arm.

10. The invention as set forth in claim 9, wherein:

(a) said block engages the surface of the cam wheel shaft when the catapult arm is disposed in its ball-tossing position.

11. The invention as set forth in claim 1, wherein:

(a) the pivot means for the catapult arm has an axis which is substantially perpendicular to the cam wheel, and which extends through the latter at a point intermediate its periphery and its center.

12. The invention as set forth in claim 1, wherein:

(a) said pivot means for the catapult arm is mounted on the frame.

13. The invention as set forth in claim 1, and further including:

(a) a ball feed guide for feeding balls to the catapult arm one at a time, in succession, when the catapult arm moves to its ball-receiving position.

14. The invention as set forth in claim 1, wherein:

(a) said cam wheel and powered means are constituted as a power winch device.

15. An automatic ball tossing device comprising, in combination:

(a) a turnable shaft part, (b) power means for turning said shaft part, (c) a cam carried by said shaft part, (d) a catapult arm part having a cup for releasably carrying a ball and having a cam follower means intermittently engageable with said cam, (e) means pivotally mounting the catapult arm part at a point adjacent said shaft part for arcuate movement toward and away from the shaft part, (f) means biasing the catapult arm part in a direction tending to maintain the cam follower means engaged with said cam and to snap the catapult arm part against the shaft part upon disengagement of said cam and cam follower means, and (g) cushioning means carried by one of said parts and engageable with the other of said parts, for cushioning the blow when the catapult arm part is snapped against the said shaft part.

16. An automatic ball-tossing device comprising, in combination:

(a) a turnable shaft part, (b) power means for turning said shaft part, (c) a catapult arm part having means for releasably carrying a ball, (d) means driven by said shaft part for causing said arm part to automatically periodically move against and away from said shaft part, and (e) cushioning means carried by one of said parts and engageable with the other part, for absorbing the impact when the arm part moves to strike against the shaft part.

* * * * *